US010890054B2

(12) United States Patent
Loehken et al.

(10) Patent No.: US 10,890,054 B2
(45) Date of Patent: Jan. 12, 2021

(54) SHAPED CHARGE WITH SELF-CONTAINED AND COMPRESSED EXPLOSIVE INITIATION PELLET

(71) Applicant: DynaEnergetics Europe GmbH, Troisdorf (DE)

(72) Inventors: Joern Olaf Loehken, Troisdorf (DE); Liam McNelis, Bonn (DE)

(73) Assignee: DynaEnergetics Europe GmbH, Troisdorf (DE)

( * ) Notice: Subject to any disclaimer, the term of this patent is extended or adjusted under 35 U.S.C. 154(b) by 0 days.

(21) Appl. No.: 16/486,621

(22) PCT Filed: Mar. 12, 2018

(86) PCT No.: PCT/EP2018/056107
§ 371 (c)(1),
(2) Date: Aug. 16, 2019

(87) PCT Pub. No.: WO2018/177733
PCT Pub. Date: Oct. 4, 2018

(65) Prior Publication Data

US 2019/0368318 A1 Dec. 5, 2019

Related U.S. Application Data

(60) Provisional application No. 62/477,482, filed on Mar. 28, 2017.

(51) Int. Cl.
*E21B 43/117* (2006.01)
*F42B 1/028* (2006.01)
*F42B 1/032* (2006.01)

(52) U.S. Cl.
CPC ..... *E21B 43/117* (2013.01); *F42B 1/028* (2013.01); *F42B 1/032* (2013.01)

(58) Field of Classification Search
CPC ... E21B 43/117; E21B 43/1185; E21B 43/116
See application file for complete search history.

(56) References Cited

U.S. PATENT DOCUMENTS 4,627,353 A 12/1986 Chawla
5,421,418 A * 6/1995 Nelson ..... C09K 8/12 166/293

(Continued)

FOREIGN PATENT DOCUMENTS

WO 0196807 A2 12/2001
WO 2005037735 A2 4/2005
WO 2017035337 A1 3/2017

OTHER PUBLICATIONS

EPO—International Searching Authority, International Search Report and Written Opinion of International Application No. PCT/EP2018/056107, dated May 29, 2018, 14 pages.

(Continued)

*Primary Examiner* — Kristyn A Hall
(74) *Attorney, Agent, or Firm* — Moyles IP, LLC

(57) ABSTRACT

A shaped charge comprises a case including a wall that defines a hollow interior within the case. The wall includes an external surface and an internal surface. An explosive load is disposed within the hollow interior and positioned adjacent at least a portion of the internal surface. An initiation point chamber extends at least partially between the external surface and the internal surface of the wall. At least one self-contained, compressed explosive initiation pellet is contained within or adjacent the initiation point chamber. An exposed perforating gun carrier utilizing the shaped charge, and a method of using and producing the same are also contemplated.

20 Claims, 12 Drawing Sheets

(56) References Cited

U.S. PATENT DOCUMENTS

| | | | | |
|---|---|---|---|---|
| 5,567,906 | A | 10/1996 | Reese et al. | |
| 6,386,296 | B1 * | 5/2002 | Kothari | E21B 43/117 102/318 |
| 9,435,170 | B2 | 9/2016 | Bell et al. | |
| 2004/0200377 | A1 | 10/2004 | Collins et al. | |
| 2010/0263523 | A1 * | 10/2010 | Lagrange | G08B 13/2437 89/1.15 |
| 2015/0376992 | A1 * | 12/2015 | Grattan | E21B 43/117 175/4.57 |
| 2017/0058648 | A1 | 3/2017 | Geerts et al. | |

OTHER PUBLICATIONS

International Searching Authority, International Search Report and Written Opinion of PCT App. No. PCT/EP2018/056107, which is the same family U.S. Appl. No. 16/486,621, dated May 29, 2018, 9 pgs.

European Patent Office; Examination Report for EP Application No. 18711085.3; dated Nov. 6, 2020; 6 pages.

* cited by examiner

SHAPED CHARGE WITH SELF-CONTAINED AND COMPRESSED EXPLOSIVE INITIATION PELLET

CROSS-REFERENCE TO RELATED APPLICATIONS

This application claims priority to PCT Application No. PCT/EP2018/056107 filed Mar. 2, 2018, which claims the benefit of U.S. Provisional Patent Application No. 62/477,482 filed Mar. 28, 2017, the disclosure of which is incorporated herein by reference in its entirety.

FIELD

A shaped charge for use in a perforating gun is generally described. More specifically, open and encapsulated shaped charges for use in an exposed perforating gun are described.

BACKGROUND

Perforating gun assemblies are used in many oilfield or gas well completions. In particular, the assemblies are used to generate holes in steel casing pipe/tubing and/or cement lining in a wellbore to gain access to the oil and/or gas deposit formation. In order to maximize extraction of the oil/gas deposits, various perforating gun systems are employed. These assemblies are usually elongated and frequently cylindrical, and include a detonating cord arranged within the interior of the assembly and connected to shaped charge perforators (or shaped charges) disposed therein.

The type of perforating gun assembly employed may depend on various factors, such as the conditions in the formation or restrictions in the wellbore. For instance, a hollow-carrier perforating gun system having a tube for carrying the shaped charges may be selected to help protect the shaped charges from wellbore fluids and pressure (the wellbore environment). One limitation of the hollow-carrier perforating gun system is that it is often limited in inner-diameter, which may limit the size of the shaped charges it carries. An alternative perforating gun system often used is an exposed or encapsulated perforating gun system. This system may allow for the delivery of larger sized shaped charges than those of the hollow-carrier gun system. The exposed perforating gun system typically includes a carrier strip upon which shaped charges are mounted. Because these shaped charges are not contained within a hollow tube, as those of a hollow-carrier perforating gun system, the shaped charges run the risk of being exposed to the wellbore environment. This issue is typically addressed by encapsulating/sealing each individual shaped charge to prevent direct exposure to fluids and/or pressure from the wellbore environment.

Typically, shaped charges are configured to focus ballistic energy onto a target to initiate production flow. Shaped charge design selection is also used to predict/simulate the flow of the oil and/or gas from the formation. The configuration of shaped charges may include conical or round aspects having a single point of initiation through a metal case, which contains an explosive charge material, with or without a liner therein, and that produces a perforating jet upon initiation. It should be recognized that the case or housing of the shaped charge is distinguished from the casing of the wellbore, which is placed in the wellbore after the drilling process and may be cemented in place in order to stabilize the borehole prior to perforating the surrounding formations. These shaped charges focus the entire ballistic energy onto a single point on a target, thereby typically producing a round perforation hole in the steel casing pipe or tubing, surrounding cement, and/or the surrounding formation. The ballistic energy creates a detonation wave that collapses the shaped charge liner (if present), thereby forming a forward-moving high velocity jet that travels through an open end of the case of the shaped charge. In some instances, the jet pierces the perforating gun casing and/or the cement liner and forms a cylindrical or conical-shaped tunnel in the surrounding target formation.

Such shaped charges are commercially available, and general examples of these prior shaped charges are illustrated in FIGS. 1A-1D. The shaped charges 1, 1', 1" each have a case 2 having a closed end 2' and an open end/open front portion 2". Each case 2 includes a back wall 5 (or 5') at its closed end 2' and an initiation point 6 that extends between an internal surface 8*a* of the case to an external surface 8*b* of the case 2. The initiation point 6 may be a through-channel that extends through the case 2 wall (that may or may not be sealed), or alternatively a thinned region (FIG. 1D) within the case 2 wall. At least one explosive load 4 is contained within the case 2, and may be retained therein by a liner 3. At least a portion 4' of the explosive load 4 extends within/adjacent the initiation point 6 of the case 2 (and in particular within the through-channel or to the thinned-region). An externally located detonating cord 7 (FIGS. 1B-1D) is usually positioned adjacent the initiation point 6, along the external surface 8*b* of the case 2. When the detonating cord 7 is initiated, a detonating wave (or initiation energy produced upon the initiation of the detonating cord) travels along the detonating cord 7 to the portion 4' of the explosive load 4, and ultimately to the explosive load 4. The subsequent energy or power of the explosion created by detonation of the explosive load 4 depends, at least in part, on the types of explosives used to form the explosive load 4. FIG. 1A illustrates a partial perspective view of a prior art shaped charge which is open at one end, and having a conical shaped back wall 5, a liner 3, and an explosive load 4 contained between the conical shaped back wall internal surface and the liner 3. FIG. 1B illustrates a cross-sectional view of another prior art slotted shaped charge 1', which is also open at one end, and having a relatively flat back wall 5', a liner 3, and an explosive load 4 contained between the internal surface of the back wall 5' and the liner 3. The through-channel is easily visible in the back wall 5' in which a portion of the explosive load 4' is located.

Some shaped charges are encapsulated for protection from environmental conditions within the wellbore. Such shaped charges are mostly sealed with caps at what would normally be the shaped charge open end. FIG. 1C illustrates a cross-sectional view of an alternative prior art shaped charge on which on the open end, a cap can be placed to encapsulate the contained explosive load 4. As in the prior figure, a portion of the explosive load 4' extends to the initiation point 6. The initiation point 6 is formed at the thinned region of the back wall 5. FIG. 1D illustrates an enlarged portion of FIG. 1C showing the thinned region. The thinned region may be contiguously formed along the back wall 5, so that the initiation point 6 is adjacent the detonating cord 7. Additionally, at detonating cord holder 9 may be provided to help hold the detonating cord 7 in place adjacent the initiation point 6.

Encapsulated charges using high temperature stable explosives that are insensitive to initiation such as Hexanitrostilbene (HNS), 2,6-Bis(picrylamino)-3,5-dinitropyridine (PYX), or triamino-trinitrobenzene (TATB), may be extremely difficult to reliably initiate. Because HNS has a reduced detonation energy output, compared to other conventional oilfield explosives, it also has a relatively low initiation sensitivity, compared to other conventional oilfield explosives. When HNS is utilized in encapsulated shaped charges, its ability to initiate decreases even further due to the presence of a solid metal layer at the initiation point of the pressure sealed or encapsulated charge. This solid metal layer is often designed to withstand high hydraulic pressures, by virtue of increasing the thickness of the layer or incorporating other geometrical designs. A severe disadvantage with this arrangement is that the thickness of the solid metal layer must be increased due to the high hydraulic pressures within the wellbore where the shaped charge will be deployed/initiated. Due to the reduced initiation sensitivity, encapsulated shaped charges that include HNS or other insensitive explosive types and a relatively thick solid metal barrier layer as part of the charge case are often unable to initiate reliably using a detonating cord that also includes the same type of explosive (for instance, a HNS detonating cord).

According to the disadvantages described above, there is a need for a device and method that provides for a combination and arrangement of high temperature stable, insensitive explosives within a shaped charge, that also withstands the high hydraulic pressures of a wellbore. Further, there is a need for a shaped charge that is water and pressure insensitive, and includes an enhanced detonation capability. There is a further need for a shaped charge that provides a reliable initiation sensitivity. There is also a need for a perforating gun carrier system that is able to receive shaped charges of non-standard sizes.

BRIEF DESCRIPTION

This disclosure generally describes shaped charges for use in perforating guns. The shaped charges generally include a case having at least one wall that defines a hollow interior within the case. The wall includes an external surface and an internal surface. An explosive load is disposed within the hollow interior of the case, and is positioned so that it is adjacent at least a portion of the internal surface. The case further includes an initiation point chamber that at least partially extends between the external surface and the internal surface of the wall. The initiation point chamber may encompass a through-channel within, or a thinned-region of the wall. At least one self-contained, compressed explosive initiation pellet is contained within or adjacent the initiation point chamber. In an embodiment, the self-contained, compressed explosive initiation pellet is non-water soluble. The self-contained, compressed explosive initiation pellet may be a distinct explosive material, separate from the explosive load material, and may be limited in location to the initiation point chamber (as opposed to occupying a significant portion of the hollow interior of the case). According to an aspect, the self-contained, compressed explosive initiation pellet is of a different chemical composition from the explosive load, and includes additional components that have been mixed with explosive material, such components being different from those components found in the explosive load material. Further, the self-contained, compressed explosive initiation pellet may be physically separated from the explosive load.

The present disclosure further describes the shaped charge having a case with an open front portion, a back wall portion, and at least one side wall portion extending between the open front portion and the back wall portion. According to an aspect, the back wall portion and the side wall portion define a hollow interior. An explosive load is disposed adjacent the back wall portion and at least a part of the side wall portion, so that the explosive load is disposed in the hollow interior. The self-contained, compressed explosive initiation pellet may be placed in an enclosed cavity, which separates the self-contained, compressed explosive initiation pellet from the explosive load. The shaped charge may further include a cap configured to close the open front portion of the case, thereby forming a hermetically-sealed shaped charge (also know as an encapsulated shaped charge). The cap may help prevent fluids and pressure external to the hermetically sealed shaped charge from entering the internal space of the hermetically sealed shaped charge.

According to an aspect, the shaped charges described hereinabove are particularly suited for use in an exposed perforating gun carrier system. They may also be utilized with a closed perforating gun, such as a gun design including a shaped charge/(s) within a tubular structure. In an embodiment, the exposed perforating gun carrier system includes a shaped charge carrier configured for receiving the shaped charges.

The present embodiments also relate to a method of perforating a wellbore utilizing using a shaped charge including the self-contained, compressed explosive initiation pellet. According to an aspect, the method includes arranging at least one shaped charge within a perforating gun, positioning the perforating gun at a perforating location within a wellbore, and initiating the at least one shaped charge. The shaped charge arranged in the perforating gun may include a case having a hollow interior, a liner housed within the case, an explosive load disposed within the hollow interior, an initiation point chamber extending along an external surface of the case, and at least one self-contained, compressed explosive initiation pellet adjacent or within the initiation point chamber. The self-contained, compressed explosive initiation pellet may be integrated with the case of shaped charge. According to an aspect, the perforating location includes a hydraulic pressure that is less than a compression pressure of the self-contained, compressed explosive initiation pellet. The initiation of the shaped charge may include detonating the self-contained, compressed explosive initiation pellet and transferring the energy from detonation of the self-contained, compressed explosive initiation pellet to the explosive load.

The present embodiments further relate to a method of making a shaped charge having an integrated, self-contained, compressed explosive initiation pellet. According to an aspect, the method includes providing a self-contained, compressed explosive initiation pellet that utilizes an explosive material. The method may further include adding a hydrophobic substance with the explosive material to form the self-contained, compressed explosive initiation pellet. In a further embodiment, the method may include compressing the mixed explosive material and hydrophobic substance to a certain level to form the self-contained, compressed explosive initiation pellet, and then placing the self-contained, compressed explosive initiation pellet within the shaped charge such that it is situated within the shaped charge at a location within the initiation point chamber of the shaped charge, and alternatively, physically separated from the explosive load of the shaped charge. In an embodiment, the method includes providing a case having an open front portion, a back wall portion, at least one side wall portion extending between the open front portion and the back wall portion, and a hollow interior defined by the back wall portion and the side wall portions. An initiation point chamber may be provided in the back wall portion, so that the initiation point chamber extends between an external surface and an internal surface of the back wall portion. According to an aspect, the method includes disposing the self-contained, compressed explosive initiation pellet within or adjacent the initiation point chamber, and disposing a separate explosive load within the hollow interior, the separate explosive load being physically separated from the self-contained, compressed explosive initiation pellet. In such described embodiments, a shaped charge is produced or utilized, which allows for the incorporation of an environmentally insensitive explosive material in combination with a more sensitive explosive material, providing benefits to a drilling operation that would not normally be available from a shaped charge that utilizes a single environmentally sensitive explosive material alone.

BRIEF DESCRIPTION OF THE FIGURES

A more particular description of the disclosure will be rendered by reference to specific embodiments thereof that are illustrated in the appended drawings. Understanding that these drawings depict only typical embodiments thereof and are not therefore to be considered to be limiting of its scope, exemplary embodiments will be described and explained with additional specificity and detail through the use of the accompanying drawings in which.

Figure 1A:
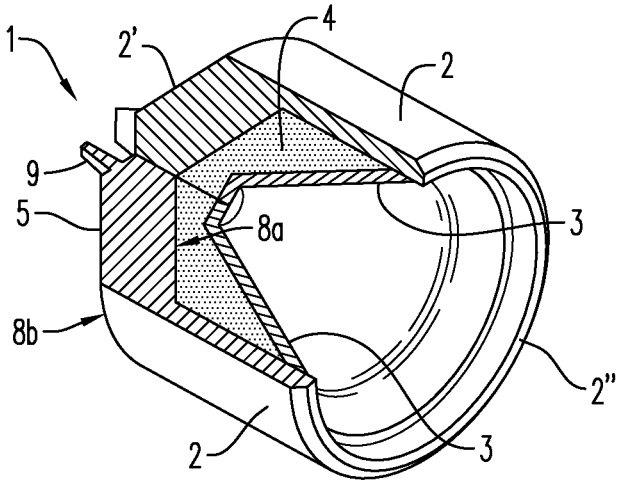
FIG. 1A (PRIOR ART)
FIG. 1A is perspective view of a conical shaped charge according to the prior art.
Figure 1B:
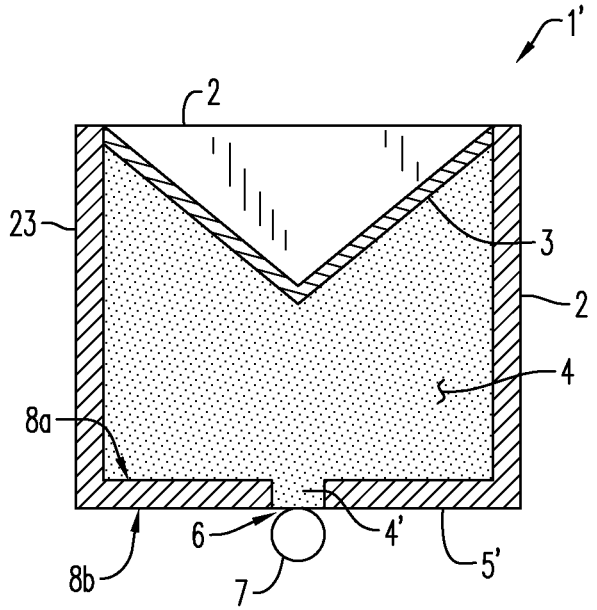
FIG. 1B (PRIOR ART)
FIG. 1B is a side, cross-sectional view of a slot shaped charge according to the prior art.
Figure 1C:
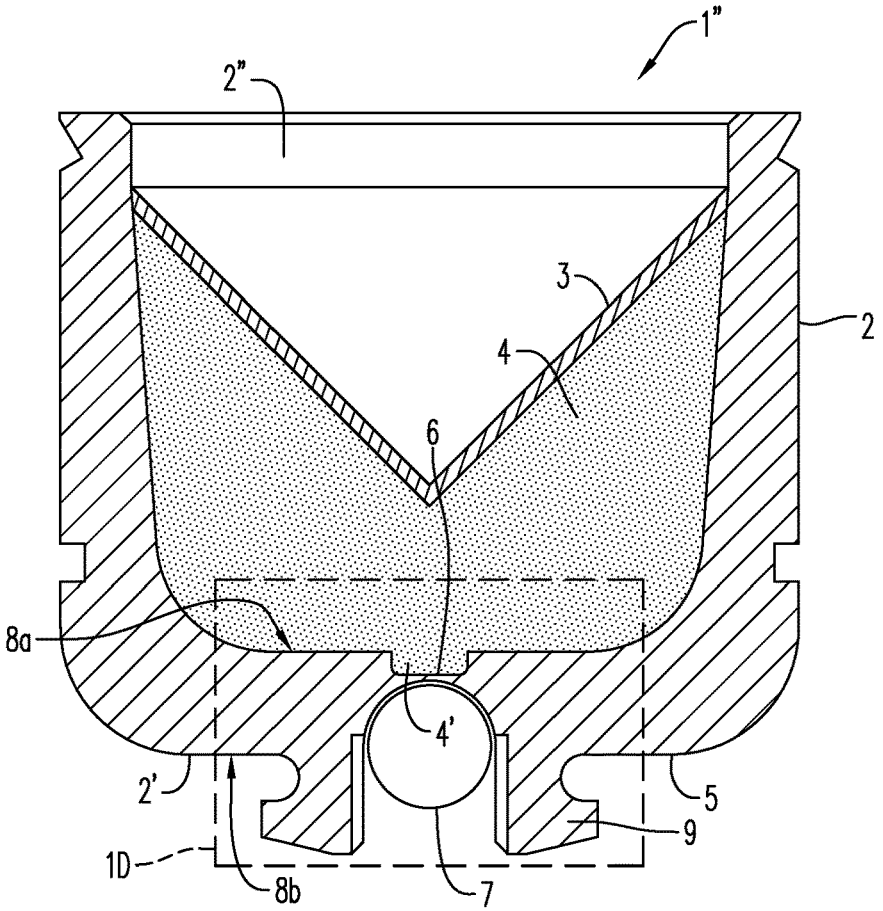
FIG. 1C (PRIOR ART)
FIG. 1C is a side, cross-sectional view of a conical shaped charge according to the prior art.
Figure 1D:
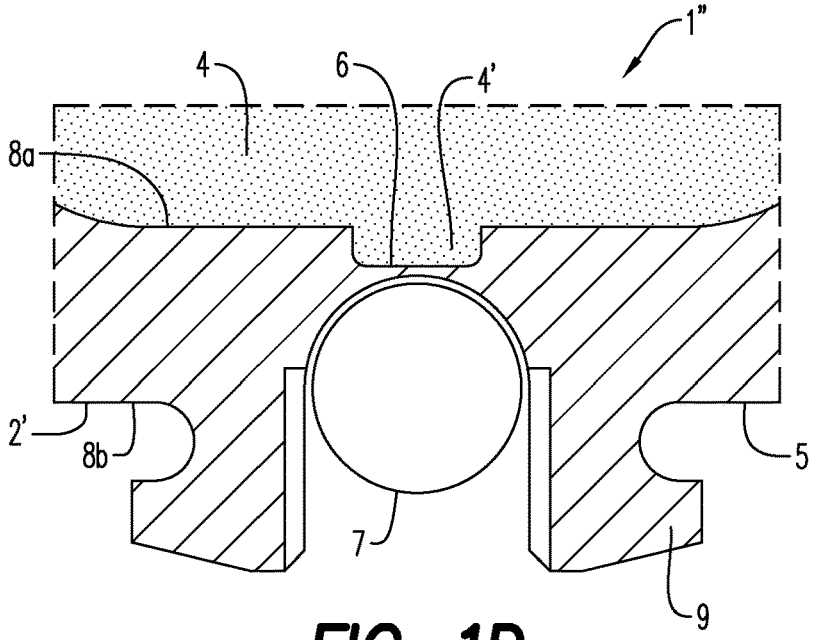
FIG. 1D (PRIOR ART)
FIG. 1D is an enlarged side cross-sectional view of an initiation point of the conical shaped charge of FIG. 1C.

Various features, aspects, and advantages of the embodiments will become more apparent from the following detailed description, along with the accompanying figures in which like numerals represent similar components throughout the figures and text. The various described features are not necessarily drawn to scale, but are drawn to emphasize specific features relevant to some embodiments.

DETAILED DESCRIPTION

Reference will now be made in detail to various embodiments. Each example is provided by way of explanation, and is not meant as a limitation and does not constitute a definition of all possible embodiments.

A shaped charge is generally described herein, having particular use in conjunction with a perforating gun assembly. In an embodiment, the shaped charge is configured for use with a perforating gun assembly, in particular for oilfield or gas well drilling or completions. The shaped charge may include a case. According to an aspect, the case includes at least one wall that defines a hollow interior within the case. As used herein, the term "hollow interior" refers to a space within the case, which may include a liner and an explosive load therein. It should be understood, however, that the case is not entirely hollow once the explosive load and/or the liner is positioned therein. The at least one wall may include an external surface, and an internal surface that defines the hollow interior. In an embodiment, an explosive load is disposed within the hollow interior of the case, and is positioned so that it is adjacent at least a portion of the internal surface. The case may further include an initiation point chamber that at least partially extends between the external surface and the internal surface of the wall. In one aspect, the initiation point chamber may be at a through-channel in the wall, or alternatively, at a thinned-region of the wall or in a cavity of the wall. The shaped charge may include a precision-machined metal layer at the initiation point chamber, which serves as a mechanical barrier to withstand hydraulic pressures in the wellbore. According to an aspect, the shaped charge includes a self-contained, compressed explosive initiation pellet that serves as an energetic booster that is powerful enough to break the mechanical barrier. As used herein, the term "self-contained" refers to a pre-formed material that demonstrates its desired properties, so that it has a three-dimensional self-supporting structure. Utilization of the self-contained, compressed explosive initiation pellet at the initiation point chamber enables an increased thickness of the mechanical barrier at the initiation point chamber, helping to facilitate a shaped charge that has increased pressure resistance ratings. In an embodiment, the self-contained, compressed explosive initiation pellet is integrated within the shaped charge structure, and is distinct from the explosive load. As used herein, the term "integrated" refers to the incorporation of the self-contained, compressed explosive initiation pellet within a cavity formed in/immediately adjacent to a wall of the case, so that the self-contained, compressed explosive initiation pellet is essentially a part of (or combined with) the structure of the case, as opposed to being a continuous extension of the explosive load. In some instances, the self-contained, compressed explosive initiation pellet is physically separated from the explosive load by a physical barrier. According to an aspect, the self-contained, compressed explosive initiation pellet is formed from an explosive material that is distinct from the explosive load material (s).

For purposes of illustrating features of the embodiments, an example will now be introduced and referenced throughout the disclosure. Those skilled in the art will recognize that this example is illustrative and not limiting and is provided purely for explanatory purposes.

Figure 2:
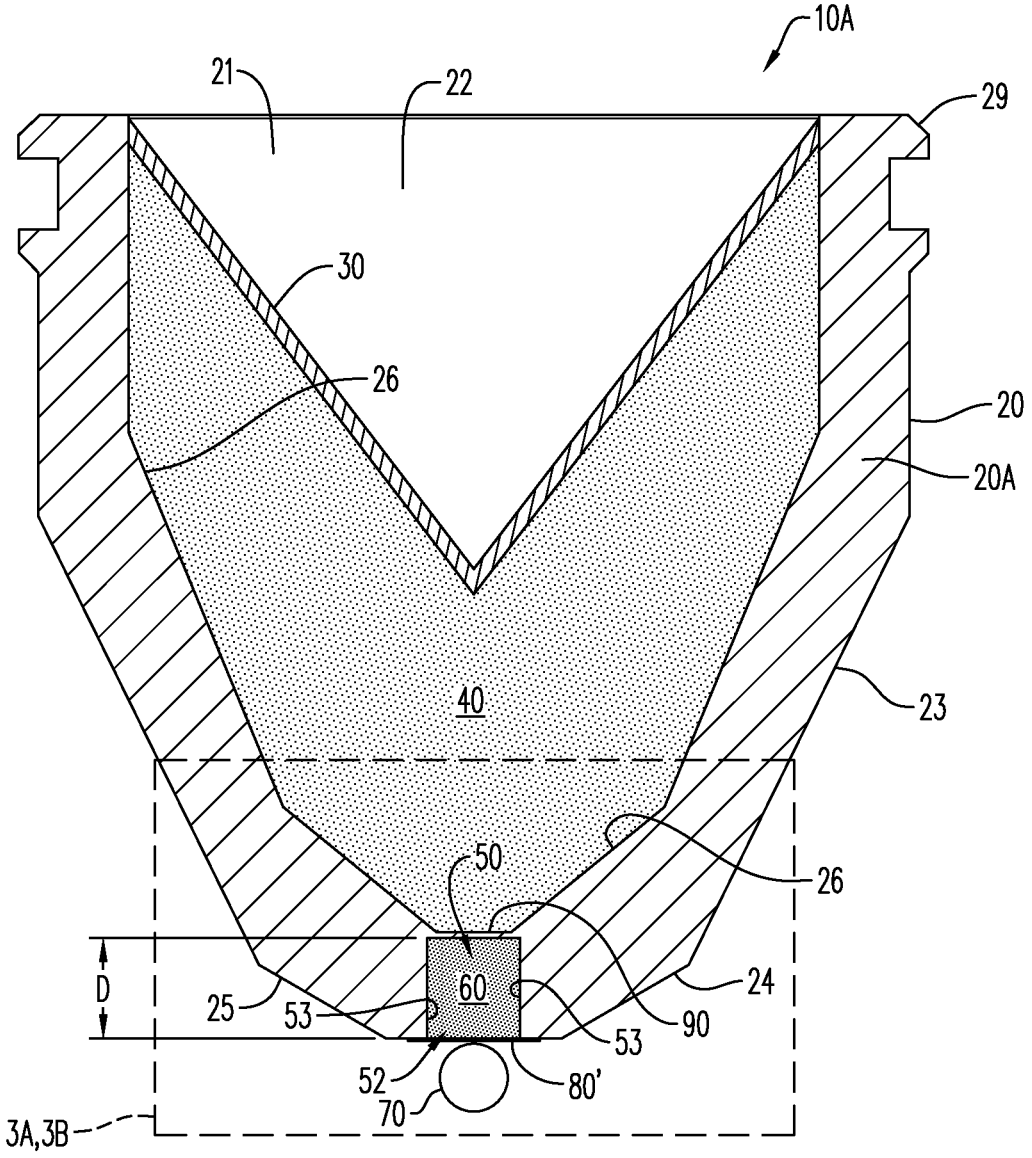
FIG. 2 is a side, cross-sectional view of a shaped charge having a self-contained, compressed explosive initiation pellet disposed adjacent an initiation point chamber, according to an aspect.
Figure 6A:
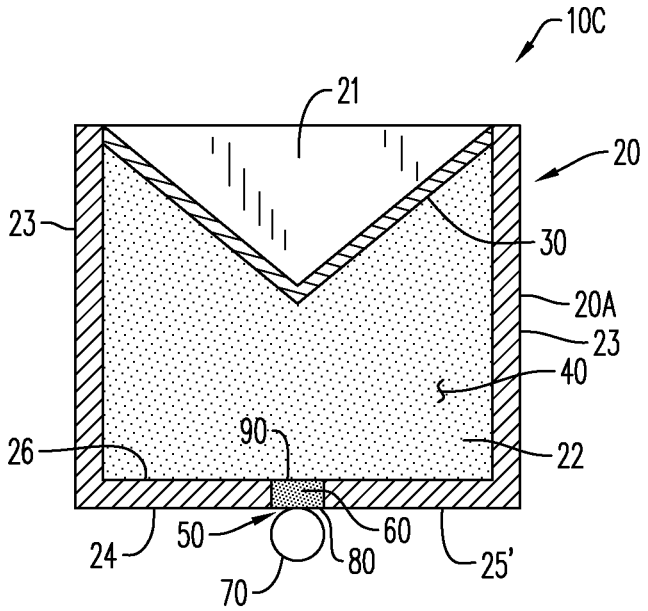
FIG. 6A is a side, cross-sectional view of a slot shaped charge including a self-contained, compressed explosive initiation pellet and an explosive load, according to an aspect.
Figure 6B:
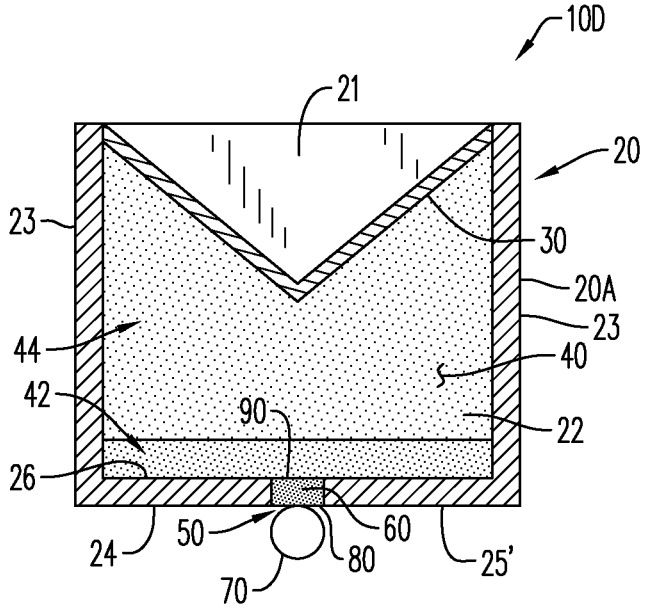
FIG. 6B is a side, cross-sectional view of an alternative embodiment of a slot shaped charge with a self-contained, compressed explosive initiation pellet, and illustrating a primer explosive load and a main explosive load positioned in a hollow interior of the shaped charge.
Figure 7:
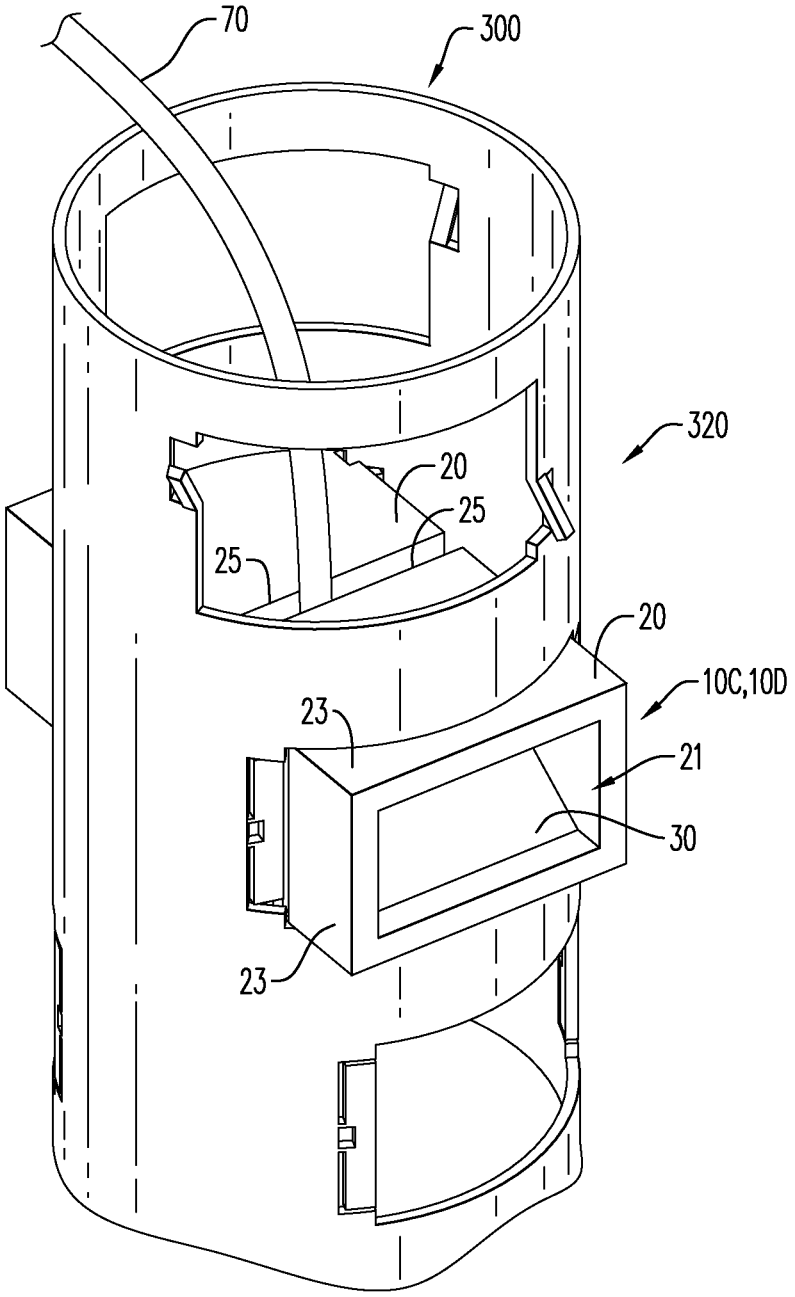
FIG. 7 is a perspective view of a perforating gun carrier include a plurality of shaped charges, according to an aspect.

Turning now to the figures, FIGS. 2, 3A-3B, and 6A-6B illustrate exemplary shaped charges 10A/10B/10C/10D. In particular, FIGS. 2, and 3 illustrate conical shaped charges 10A/10B, while FIGS. 6A-6B, and FIG. 7 illustrate slot shaped charges 10C/10D. The conical shaped charges 10A/10B include a cone-shaped back wall 25, while the slot-shaped charges 10C/10D include a substantially flat back wall 25' defining a slot opening. According to an aspect, both the conical shaped charge 10A/10B and the slot shaped charge 10C/10D include open front portions 21 opposite their back walls 25, 25'.

The shaped charges 10A/10B/10C/10D each include a case 20. The case 20 may be formed from machinable steel, aluminum, stainless-steel, copper, zinc material, and the like. According to an aspect, the case 20 is substantially cylindrical and includes at least one wall 20A. According to an aspect, the case 20 includes an open front portion 21, the back wall portion 25, 25', and at least one side wall portion 23. The side wall portion 23 extends between the open front portion 21 and the back wall portion 25. According to an aspect, the back wall portion 25, 25', and the side wall portion 23 of the wall 20A define a hollow interior 22 within the case 20. It should be understood that the shaped charge 10A/10B/10C/10D is not entirely hollow once an explosive load 40 and/or a liner 30 is positioned within the hollow interior 22. The wall 20A includes an external surface 24 and an internal surface 26, the hollow interior 22 extending between the internal surface 26 of the wall 20A.

The shaped charges 10A/10B/10C/10D may include an explosive load 40 enclosed (i.e., encased or disposed) within the hollow interior 22. According to an aspect, the explosive load 40 contacts/abuts at least a portion of the internal surface 26 of the wall 20A. The explosive load 40 may be adjacent the back wall portion 25, 25' and a portion of the side wall portions 23 of the wall 20A. In an embodiment, the explosive load 40 comprises at least one of pentaerythritol tetranitrate (PETN), cyclotrimethylenetrinitramine (RDX), octahydro-1,3,5,7-tetranitro-1,3,5,7-tetrazocine/cyclotetramethylene-tetranitramine (HMX), PYX, FINS, TATB, and PTB (mixture of PYX and TATB).

Figure 4:
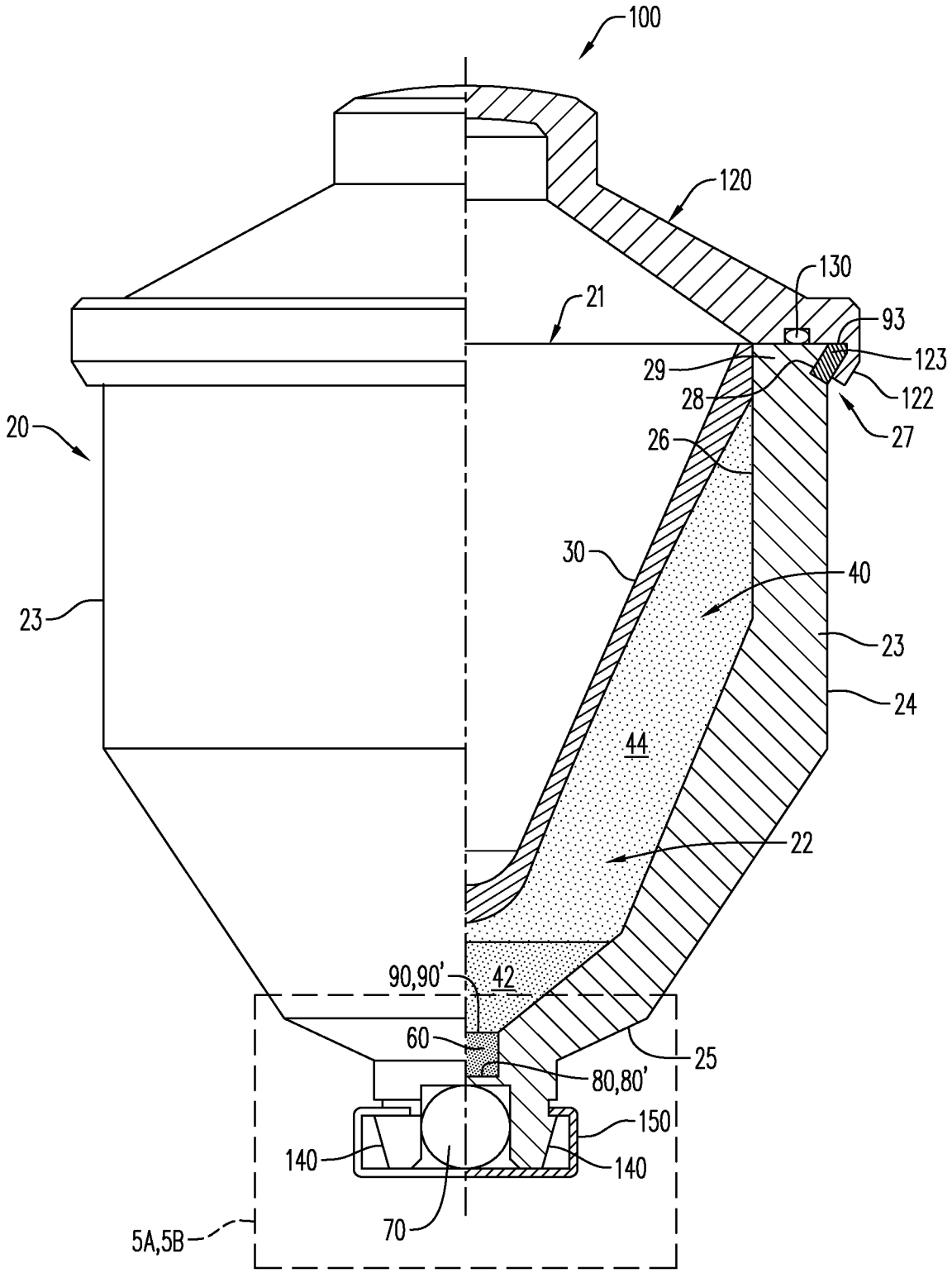
FIG. 4 is a side, partial cross-sectional view of a hermetically sealed shaped charge (also known as an encapsulated shaped charge), according to an aspect.

As illustrated in FIGS. 4 (which shows an encapsulated shaped charge) and 6B, the explosive load 40 may include a primer explosive load 42 and a secondary/main explosive load 44. In an embodiment, the primer explosive load 42 is positioned so that it is adjacent the back wall portion 25, 25', and the main explosive load 44 is positioned adjacent the primer explosive load 42 so that the primer explosive load 42 is between the back wall portion 25, 25' and the main explosive load 44. In an embodiment, the primer explosive load 42 includes sensitive explosive materials, such as pure RDX, pure HMX, pure HNS, and the like. The primer and main explosive loads 42, 44 may include explosive materials that are identical to each other, with the primer explosive load 42 being readily detonated by the ignition/detonation of a self-contained, compressed explosive initiation pellet 60 and/or a detonating cord 70 (described in further detail hereinbelow), and the main explosive load 44 being detonated only upon the detonation of the primer explosive load 42. According to an aspect, the primer explosive load 42 is different from the main explosive load 44. According to one aspect of the disclosure, the primer explosive load 42 is formed from pure HNS, while the main explosive load 44 is formed from HNS mixed with an additive.

According to an aspect, the shaped charges 10A/10B/10C/10D each include a liner 30. The liner 30 may be pressed into or positioned over the explosive load 40. According to an aspect, the liner 30 is seated within the case 20 adjacent the internal surface 26 to substantially enclose the explosive load 40 therein. In shaped charges including both primer and main explosive loads 42, 44, the liner 30 is adjacent the main explosive load 44. According to an aspect, the liner 30 includes one of more components, such as powdered metallic materials and/or powdered metal alloys, and binders. Each component may be selected to create a high-energy output or jet velocity upon detonation of the shaped charges 10A/10B/10C/10D. According to an aspect, the powdered metallic materials may include aluminum, lead, nickel, titanium, bronze, tungsten, alloys, and mixtures thereof. In an embodiment, the liner 30 is formed by cold-pressing the powdered metallic materials to form a liner shape. The liner shapes contemplated for the liner 30 may include any desired liner shape, including hemispherical, trumpet, bell, tulip, and the like. The liner 30 may include reactive or energetic materials capable of an exothermic reaction when the liner material is activated or pushed above its threshold energy. Further description of liner materials that may be used in the shaped charges 10A/10B/10C/10D may be found in U.S. Pat. Nos. 3,235,005, 5,567,906, 8,220,394, 8,544,563, German Patent Application Publication No. DE 102005059934A1, and commonly-assigned U.S. Provisional Application No. 62/445,672, which are hereby incorporated by reference in their entireties.

The shaped charges 10A/10B/10C/10D may further include an initiation point chamber 50 that extends at least partially between at least one of the external surface 24 and the internal surface 26 of the wall 20A. According to an aspect, the initiation point chamber 50 extends entirely between the external surface 24 and the internal surface 26 of the back wall portion 25, 25' of the wall 20A. As seen for instance in FIGS. 3A-3B, the initiation point chamber 50 may extend from the external surface 24 of the case 20 towards the internal surface 26. The initiation point chamber 50 may include any geometric shape, such as, circular, rectangular, square, and the like.

The initiation point chamber 50 may include a cavity 52. In this configuration, the back wall portion 25, 25' of the wall 20A includes cavity wall/(s) 53, which bound the cavity 52. The cavity 52 may have an inner diameter ID having a size of from about 1.0 mm to about 10.0 mm. In an embodiment, the inner diameter ID of the cavity 52 is from about 4.0 mm to about 6.0 mm. According to an aspect, the inner diameter ID of the cavity 52 is from about 4.5 mm to about 5.0 mm. The cavity 52 may include a depth D, as measured from the internal surface to the external surface of the case 20, of from about 1.0 mm to about 10.0 mm, alternatively, from an amount of less than about 1.0 mm to less than about 10.0 mm. In an embodiment, the D of the cavity 52 is from about 2.0 mm to about 6.0 mm. The depth D may be from about 3.0 mm to 5.0 mm. While specific numerical ranges are provided for the inner diameter ID and the depth D of the cavity 52, it is well understood that each range may include a tolerance, which accounts for unplanned manufacturing deviations. For instance, when the inner diameter ID includes a nominal dimension of 1.0 mm, it may include a tolerance of about +/−0.1 mm. To be sure, the inner diameter ID and the depth D of the cavity 52 may be selected based on the critical initiation diameter of the explosive load 40 of the shaped charge 10A/10B/10C/10D. For instance, since an increase of the inner diameter ID increases the amount of hydraulic/hydrostatic pressure that can act on the initiation point chamber 50, the size of the cavity 52 of the initiation point chamber 50 should be carefully selected.

According to an aspect, and as seen best in FIG. 3, the shaped charges 10A/10B/10C/10D may include at least one self-contained, compressed explosive initiation pellet 60. According to an aspect, the self-contained, compressed explosive initiation pellet 60 is configured to transfer ballistic energy from an externally positioned detonating cord 70 adjacent both the external surface 24 of the case 20 and the initiation point chamber 50 of the shaped charges 10A/10B/10C/10D. According to an aspect, the self-contained, compressed explosive initiation pellet 60 functions as an energetic booster that facilitates initiation for the shaped charge 10 through the transfer of the ballistic energy from the detonating cord 70, particularly when the explosive load 40 includes insensitive high temperature stable explosives, such as HNS and PYX. The incorporation of the self-contained, compressed explosive initiation pellet 60 (see, for instance, FIG. 3) in the shaped charges 10A/10B/10C/10D including either just the explosive load 40 (or both the primer explosive load 42 and the main explosive load 44), enables the shaped charges 10A/10B/10C/10D to be able to withstand exposure to high pressures and/or increased temperatures, while also being able to provide more reliable initiation sensitivity.

In an embodiment, the self-contained, compressed explosive initiation pellet 60 includes a high energy explosive having a thermal decomposition temperature greater than about 276° C. (529° F.). To be sure, the self-contained, compressed explosive initiation pellet may include any other high energy explosives with a decomposition temperature higher than that of HMX. According to an aspect, the high energy explosive is one of HNS, PYX, and TATB. In an embodiment, the density of the self-contained, compressed explosive initiation pellet 60 is substantially the same as a theoretical density of the high energy explosive it contains. In an embodiment, the self-contained, compressed explosive initiation pellet 60 includes a density of from about 70% to 100% of a theoretical maximum density of the explosive load 40 disposed in the case 20.

The self-contained, compressed explosive initiation pellet 60 may be sized and shaped to be contained within the initiation point chamber 50. When the initiation point chamber 50 includes, for example, a through-channel, or a recess that extends into a portion of the back wall 25, 25', the self-contained, compressed explosive initiation pellet 60 is maintained within the initiation point chamber 50. Alternatively, when the initiation point chamber 50 includes a chamber wall (i.e., a thinned region), the self-contained, compressed explosive initiation pellet 60 may be positioned adjacent the chamber wall. In an embodiment, the self-contained, compressed explosive initiation pellet 60 includes an outer diameter (OD), and is shaped and sized to be received within the ID of the cavity 52. In an embodiment, the explosive initiation pellet 60 is shaped as a cylinder, a disc, or a trapezoid. The desired shape and size may be adjusted based on the particular needs of the application or the size of the initiation point chamber 50 within/adjacent to which the self-contained, compressed explosive initiation pellet 60 is to be positioned. According to an aspect, the OD of the self-contained, compressed explosive initiation pellet 60 is from about 1.0 mm to about 10.0 mm. The OD may be sized from about 2.0 mm to about 4.0 mm. The OD of the self-contained, compressed explosive initiation pellet 60 may be selected so that it fills the initiation point chamber 50/the cavity 52. According to an aspect, the self-contained, compressed explosive initiation pellet 60 is substantially pliable so that it conforms to the shape of the initiation point chamber 50/cavity 52.

The self-contained, compressed explosive initiation pellet 60 may include a powdered explosive material that is compressed during manufacture using a pressing force. This pressing force is sufficient to form the explosive initiation pellet 60. In an embodiment, the pressing force is greater than a hydraulic pressure (the contemplated pressure) of the surrounding wellbore in which the shaped charge 10A/10B/10C/10D is to be placed. According to an aspect, the self-contained, compressed explosive initiation pellet 60 is compressed during manufacture at a pressure of least 25,000 psi (1,724 bar). In an embodiment, the self-contained, compressed explosive initiation pellet 60 is compressed during manufacture at a pressure of from about 10,000 psi (689 bar) to about 30,000 psi (2,068 bar). The self-contained, compressed explosive initiation pellet 60 may be compressed during manufacture at a pressure of from about 15,000 psi (1,034 bar) to about 25,000 psi (1,724 bar).

According to an aspect, the self-contained, compressed explosive initiation pellet 60 further includes at least one hydrophobic substance in addition to the explosive material. The hydrophobic substance and the explosive material, such as the powdered explosive, may form a mixture. In the mixture, the hydrophobic substance may include a hydrophobic polymer, natural wax, synthetic wax, and the like. According to an aspect, the hydrophobic substance includes at least one of a hydrophobic polymer and graphite. The hydrophobic substance may be present in the mixture in an amount of between about 0.1% and about 5.0% of a total weight of the mixture. The mixture, including the explosive material and the hydrophobic substance, may be compressed together during formation, so that the self-contained, compressed explosive initiation pellet 60 is generally hydrophobic. The self-contained, compressed explosive initiation pellet 60 may be both water and pressure resistant by virtue of the explosive material and the hydrophobic material being pressed/compacted at a higher pressure than the expected hydraulic pressure to be experienced in a wellbore.

The self-contained, compressed explosive initiation pellet 60 may be disposed between an outer chamber closure wall 80 and an inner chamber closure wall 90. The outer chamber closure wall 80 may face an area external to the shaped charge 10A/10B/10C/10D, while the inner chamber closure wall 90 faces the hollow interior 22 of the shaped charge 10A/10B/10C/10D. In this configuration, the outer and inner chamber closure walls 80, 90 are operative for maintaining the self-contained, compressed explosive initiation pellet 60 within the cavity 52 of or adjacent to the initiation point chamber 50. According to an aspect, the outer and inner chamber closure walls 80, 90 help to seal the self-contained, compressed explosive initiation pellet 60 against at least one of fluids and pressure located external to the shaped charge 10A/10B/10C/10D.

Figure 3A:
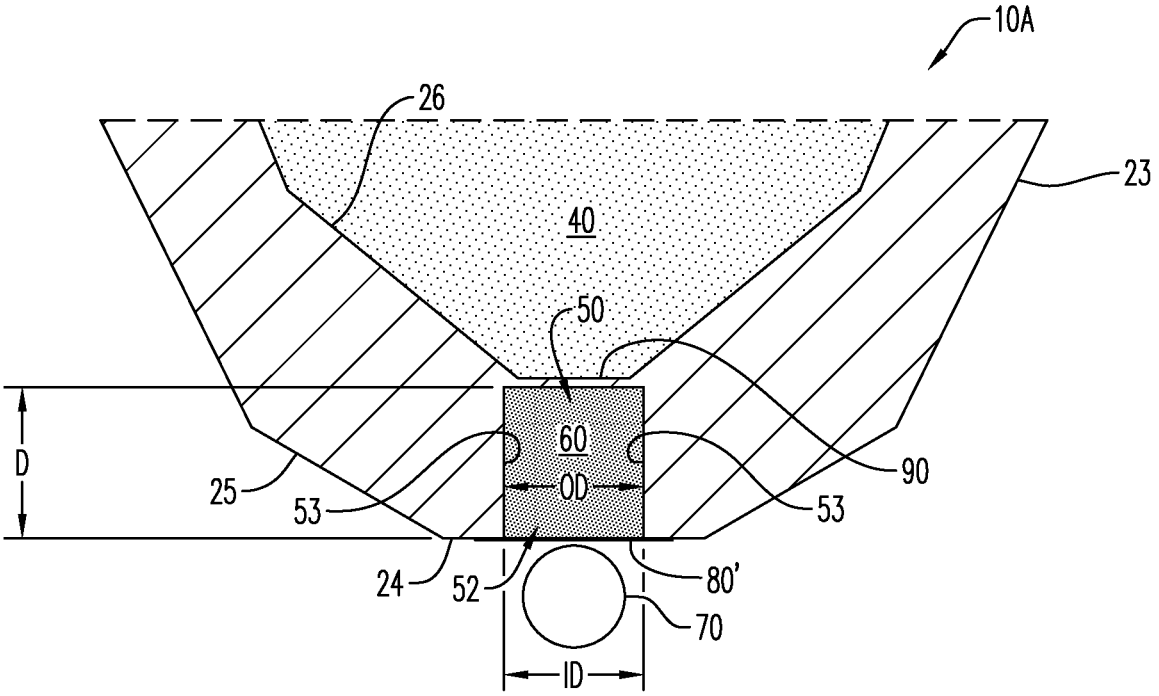
FIG. 3A is an enlarged side, cross-sectional view of the shaped charge of FIG. 2, illustrating the self-contained, compressed explosive initiation pellet housed in the initiation point chamber and secured by outer and inner chamber closure walls.
Figure 3B:
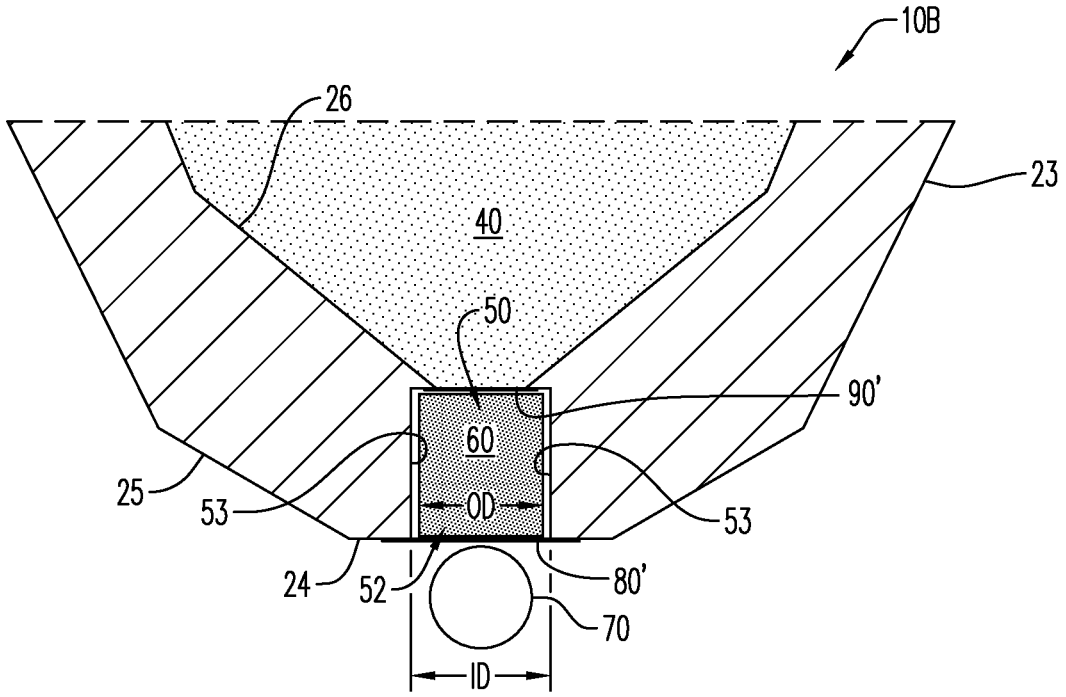
FIG. 3B is an enlarged side, cross-sectional view of a shaped charge, illustrating the self-contained, compressed explosive initiation pellet housed in the initiation point chamber and secured therein by outer and inner chamber closure walls.

As illustrated in FIG. 2, one of the outer chamber closure wall 80 and the inner chamber closure wall 90 may be contiguously formed with the back wall 25, 25' of the case 20. For example, the inner chamber closure wall 90 may be an extension of the wall 20A, i.e., and may help to form the initiation point chamber 50. FIG. 3B illustrates the shaped charge 10A including an inner chamber closure wall 90 that is contiguous with the case walls 20A, and an outer chamber closure wall 80' that is non-contiguous with the case walls 20A.

The outer chamber closure wall 80, 80' may include a layer of at least one of a lacquer, an aluminum tape, a pressure sensitive adhesive appliqué, a metal sheath, and a foil sticker. According to an aspect, if the outer chamber closure wall 81 is a lacquer, it may be selected from high temperature stable lacquer, or multiple component composite materials. In an embodiment, the outer chamber closure wall 80, 80' is an isolative cap, such as, for example a bushing cap, that is positioned over at least a portion of the external surface 24 of the case 20. According to an aspect, the isolative cap is a cup-like material that is positioned over the self-contained, compressed explosive initiation pellet 60. The isolative cap may extend over the self-contained, compressed initiation pellet 60 (arranged within the initiation point chamber 50), thereby sealing the self-contained, compressed explosive initiation pellet 60 against fluids and pressure external to the shaped charge 10A/10B/10C/10D.

In an embodiment, the inner chamber closure wall 90 is a pressure resistant material. According to an aspect, the inner chamber closure wall 90 may have an increased pressure resistance rating, by virtue of the inner chamber wall 90 being an extension of the back wall 25, 25' of the case 20. In an embodiment, when the pressure resistant material is a separate metal layer or when the inner chamber closure wall 90 is an extension of the back wall 25, 25', the inner chamber closure wall 90 may have a thickness of about 0.1 mm to about 1.0 mm. The inner chamber closure wall 90 may include a thickness of from about 0.2 mm to about 0.5 mm. According to an aspect, the inner chamber closure wall 90 includes a thickness of 0.3 mm. The metal layer forming the inner chamber closure wall 90 may be formed contiguously with the back wall portion 25, 25' of the case 20, thus including the same material used to form the wall 20A. According to an aspect, the metal layer forming the inner chamber closure wall 90'includes a layer of material that is separate from the case 20, extends over/covers the initiation point chamber 50, and is adjacent the internal surface 26 of the case 20. Through the integration/incorporation of the self-contained, compressed explosive initiation pellet 60 within the walls 20A of the case 20 of the shaped charge 10, it is possible to provide a case 20 having thicker walls 20A than the currently available shaped charges. Indeed, the thickness of the inner chamber closure wall 90, 90' may be greater than the thickness of the walls 20A of standard shaped charges, to provide for higher shaped charge pressure ratings. In an embodiment, when the outer chamber closure wall 80, 80' is formed from a metal sheath or foil that is non-contiguous with the case wall 20A, the outer chamber closure wall 80, 80' is selected from steel, and aluminum types of metal foils. The embodiment shown in FIG. 3B illustrate an embodiment in which the outer chamber closure wall 81 is non-contiguous with the case wall 20A.

EXAMPLES

Various shaped charges having self-contained, compressed explosive initiation pellets adjacent their initiation point chambers were made, according to the embodiments of the disclosure. The shaped charges where detonated, and the entrance hole diameters presented in the Examples shown in Table 1 are based on the minimum and maximum hole diameter formed by the perforation jet upon detonation of the shaped charges, while the simulated through-tubing perforating is based on the average length of the perforation hole formed by the perforation jet.

TABLE 1

| | Entrance Hole Diameter Range(s) | | Average Concrete Target Penetration | Pressure Rating of |
|---|---|---|---|---|
| Sample | Minimum Entrance Hole Diameter (millimeters (mm)) | Maximum Entrance Hole Diameter (millimeters (mm)) | (Simulating Through-Tubing Perforating (millimeters (mm)) | Encapsulated Shaped Charge (pounds per square inch (psi)) |
| A-1 | 7.8 | 9.4 | 713 | >34,500 |
| A-2 | 7.3 | 9.55 | 649 | >38,000 |
| A-3 | 7.7 | 9.0 | 697 | >40,000 |

The shaped charges tested (the results of the tests being presented in Table 1), each included a self-contained, compressed explosive initiation pellet 60 within their respective initiation point chambers 50. Each of the self-contained, compressed explosive initiation pellets 60 included HNS, and were compressed at a pressure of about 30,000 psi. The pellets were manually inserted within their respective initiation point chambers 50 by an operator. Each shaped charge included an outer chamber closure wall formed of steel, and an inner chamber closure wall formed of steel. The thickness of the inner chamber closure wall 90 of each of the Samples A-1, A-2, and A-3 were varied. In Sample A-1, the inner chamber closure wall had a thickness of about 0.1 mm to 0.7 mm. In Sample A-2, the inner chamber closure wall 90 had a thickness of about 0.2 mm to 1.0 mm. In Sample A-3, the inner chamber closure wall 90 had a thickness of about 0.3 mm to 1.5 mm. Each inner chamber closure wall 90 included a pressure tolerance of about 20% less than the tested collapse pressure of the shaped charge sample. A pressure and temperature resistant detonating cord 70 was positioned adjacent the initiation point chamber 50 and the shaped charges were detonated. The detonating cord 70 included an explosive core of HNS, a detonating velocity of up to 6,600 m/sec and a tensile rating of up to 1,000 N. Each shaped charge was tested for perforation characteristics in steel coupons having a thickness of 10 mm, to simulate the casing or tubular downhole, as well as a concrete target to check for penetration values. The concrete target utilized had an average unconfined compressive strength rating of about 6,400 psi. The shaped charges were each positioned at a typical clearance distance to represent a downhole scenario. Successful initiation was achieved up to 100% of the time, and in some instances, up to 80% of the time. Notably, in Sample A-3, having an inner chamber closure wall 90 with increased thickness, successful initiation was achieved up to 80% of the time.

Alternatively, embodiments of the present disclosure are further directed to a hermetically sealed shaped charge 100 (also known as encapsulated shaped charges). As illustrated in FIG. 4, the hermetically sealed shaped charge 100 includes a case 20. The case 20 includes an open front portion 21, a back wall portion 25, and at least one side wall portion 23 that extends between the open front portion 21 and the back wall portion 25. In an embodiment, a hollow interior 22 is defined by the back wall portion 25 and the side wall portion 23. The hollow interior 22 is adjacent the back wall portion 25 and the side wall portion 23. An explosive load 40 may be disposed within the hollow interior 22. According to an aspect, the explosive load 40 includes a primer explosive load 42 and a main explosive load 44. The primer explosive load 44 is positioned adjacent the initiation point chamber 50 and the main explosive load 44 is positioned adjacent the primer explosive load 42, opposite of the initiation point chamber 50. It should be recognized, that in lieu of multiple explosive loads, one explosive load may be utilized as with previously described embodiments.

According to an aspect, the case 20 includes an external surface 24 and an internal surface 26. An initiation point chamber 50 may be disposed at the back wall portion 25, and may extend substantially between the external surface 24 and the internal surface 26. As see in FIGS. 4, 5A and 5B, at least one self-contained, compressed explosive initiation pellet 60 may be disposed adjacent or within the initiation point chamber 50.

For purposes of convenience, and not limitation, the general characteristics of the shaped charges 10A/10B/10C/10D (open shaped charges), though applicable to the hermetically sealed shaped charge 100, are described above with respect to the FIGS. 2 and 3, and are not repeated here. Differences between the open shaped charges 10A/10B/10C/10D and hermetically sealed shaped charges 100 will be elaborated below.

FIG. 4 illustrates the case 20 of the hermetically sealed shaped charge 100 including a shoulder 27 formed at the upper end 29 of the case 20. In an embodiment, the shoulder 27 includes a recess 28 formed in the external surface 24 of the case 20, and extending circumferentially therein. According to an aspect, the recess 28 receives at least one pressure stabilizing device 93. The pressure stabilizing device 93 may include an O-ring. The shoulder 27 may be configured for receiving a cap (i.e. a pressure-sealed lid) 120 thereon, which effectively closes the shaped charge. Specifically, the cap 120 is configured to close the open front portion 21 of the case 20. The cap 120 may include a cap retention clip 122 for being received within the recess 28. When the cap retention clip 122 is received in the recess 28, the cap 120 may be securedly fastened to the case 20. The cap retention clip 122 may include a melting ring 123. The melting ring 123 may be formed of a deformable material, such as, polyamide. According to an aspect, the melting ring 123 helps to ensure that the cap 120 is mechanically secured to the case 20, so that the cap 120 cannot be dislodged therefrom, prior to detonation. This will also help prevent an internal pressure build up and potential gas explosion, particularly if the hermetically sealed shaped charge 100 is exposed to high temperatures, such as those of a fire or unusually high wellbore temperatures.

As seen in FIG. 4, the hermetically sealed shaped charge 100 further includes at least one sealing member 130. The sealing member 130 may be positioned at one or more positions between the shoulder 27 of the case 20 and the cap 120. In an embodiment, at least one of the sealing members 130 is an O-ring positioned between the cap 122 and a position adjacent the open front portion 21. The O-ring isolates pressure outside the shaped charge 100 from any pressure within the shaped charge 100. In other words, the O-ring may help to prevent pressure located outside the shaped charge 100 from impacting the pressure of internal space of the shaped charge 100, such as the hollow interior 22 of the shaped charge 100. Together, the O-ring and the cap 120 are operative for providing a seal between the case 20 and the cap 120.

Figure 5A:
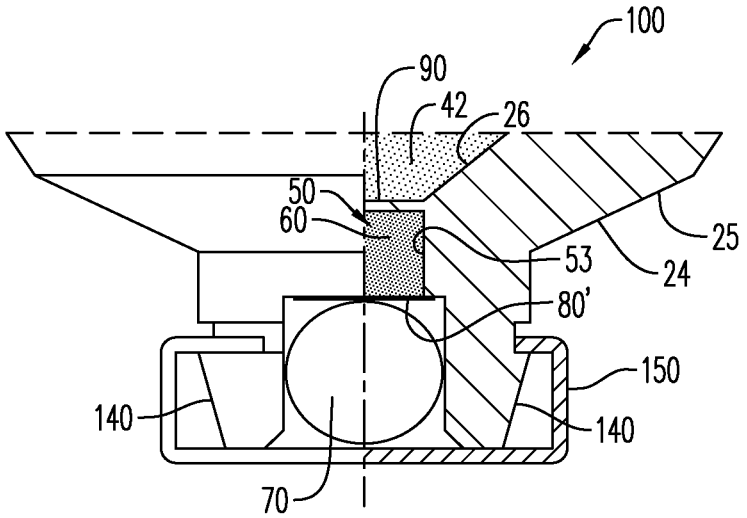
FIG. 5A is a side, partial cross-sectional view of the hermetically sealed shaped charge of FIG. 4, illustrating a cord retention clip positioned over a detonating cord.
Figure 5B:
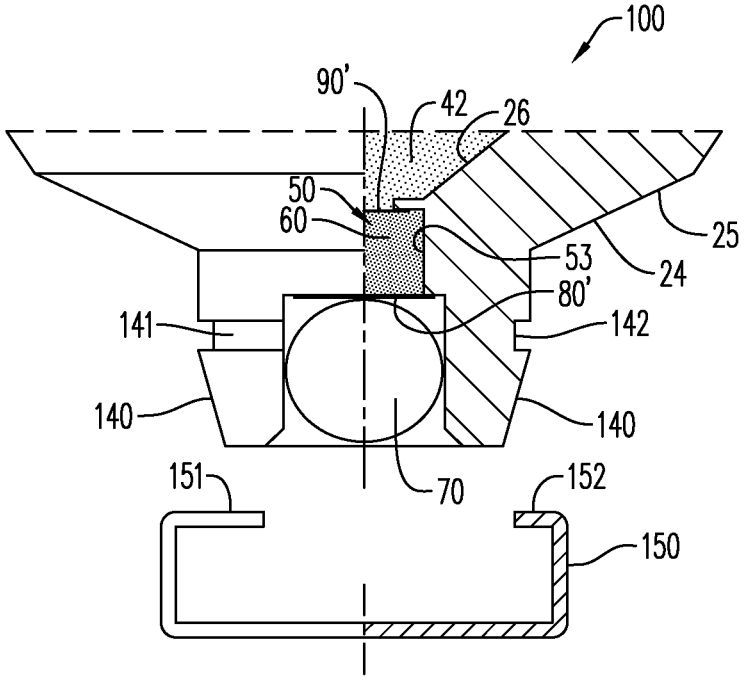
FIG. 5B is a side, cross-sectional and partially exploded view of the hermetically sealed shaped charge of FIG. 5A, illustrating the cord retention clip removed from the detonating cord.

FIGS. 5A and 5B illustrate an enlarged portion of the hermetically sealed shaped charge 100, including a plurality of detonating cord guiding members 140 extending out from the external surface 25 of the case 20 near the back wall. According to an aspect, the guiding members 140 are operative for aligning a detonating cord 70 along the external surface 25 of the shaped charge 100, adjacent the initiation point chamber 50. A cord retention clip 150 may be positioned over the guiding members, as well as over the detonating cord 70 positioned therebetween. The cord retention clip 150 may be configured to restrict movement of the externally positioned detonating cord 70 and may snap to, or hingedly extend from the detonating cord guiding members 140, such as from recesses 141, 142 in the detonating cord guiding members 140. The recesses or the clip itself may not be symmetrical in construction, in that the recesses 141, 142 may vary in shape or depth, and the clip arms 151, 152 may vary in length as seen in FIGS. 4, and 5A-5B.

Figure 8:
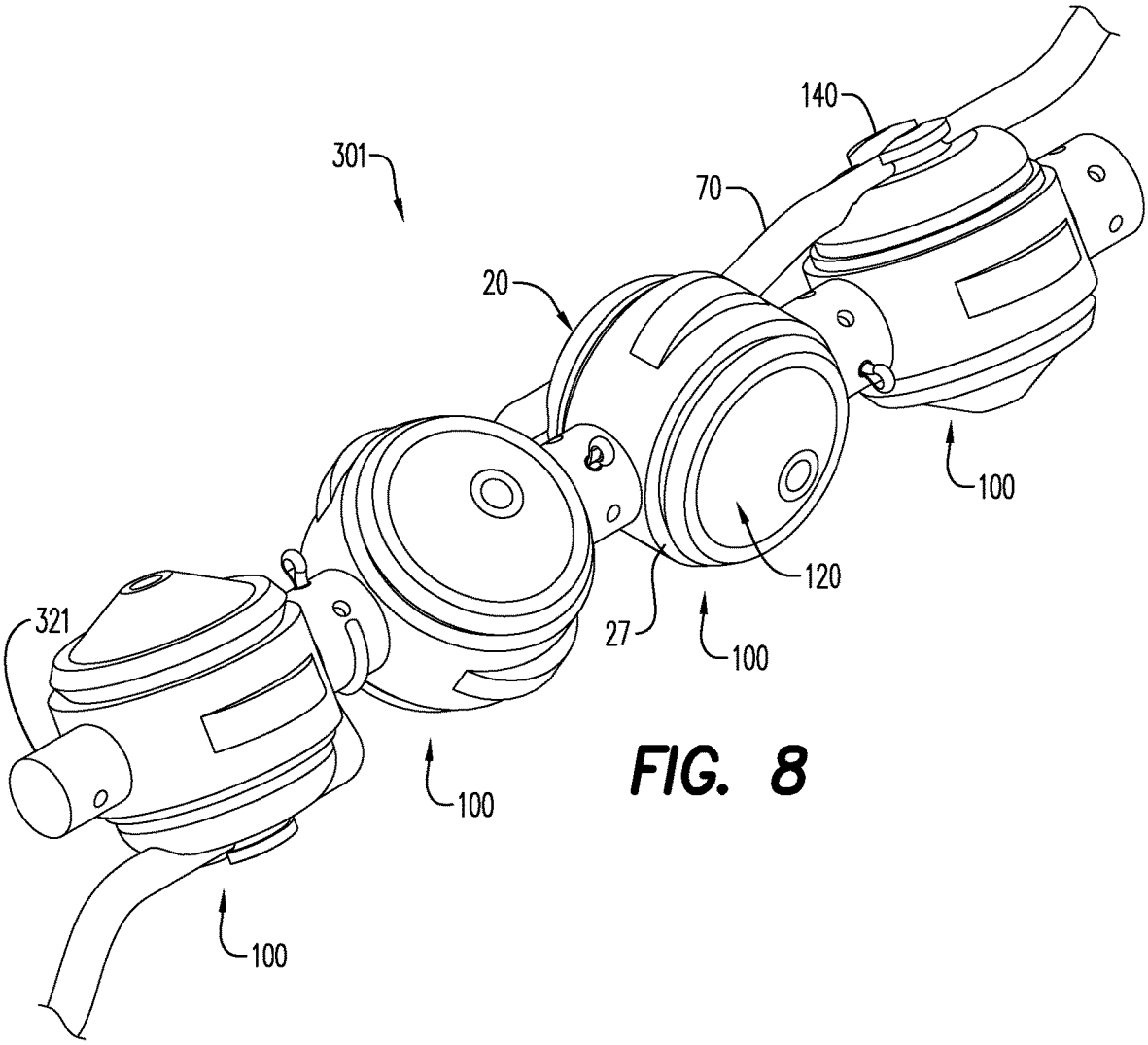
FIG. 8 is a perspective view of a plurality of hermetically sealed shaped charges positioned on a carrier strip, according to an aspect.

As seen for instance in FIGS. 7 and 8, embodiments of the present disclosure further relate to exposed perforating gun carrier systems 300, 301 (from FIGS. 7 and 8 respectively). The exposed perforating gun carrier system 300 of FIG. 7 includes a tubular shaped charge carrier 320 configured for receiving at least one shaped charge 10A/10B/10C/10D and/or hermetically sealed shaped charge 100 (not shown in FIG. 7) as described in detail hereinabove. While FIG. 7 illustrates open slot-shaped charges having rectangular/box-like configurations, such as those illustrated in FIGS. 6A-6B, it is to be understood that other shaped charges of alternate configurations (see, for instance, FIG. 2) are contemplated. As illustrated in FIG. 7, a detonating cord 70 may be positioned within the shaped charge carrier tube 320, and also adjacent the back wall portions 25 and the initiation point chambers 50 of the shaped charges.\

Figure 9:
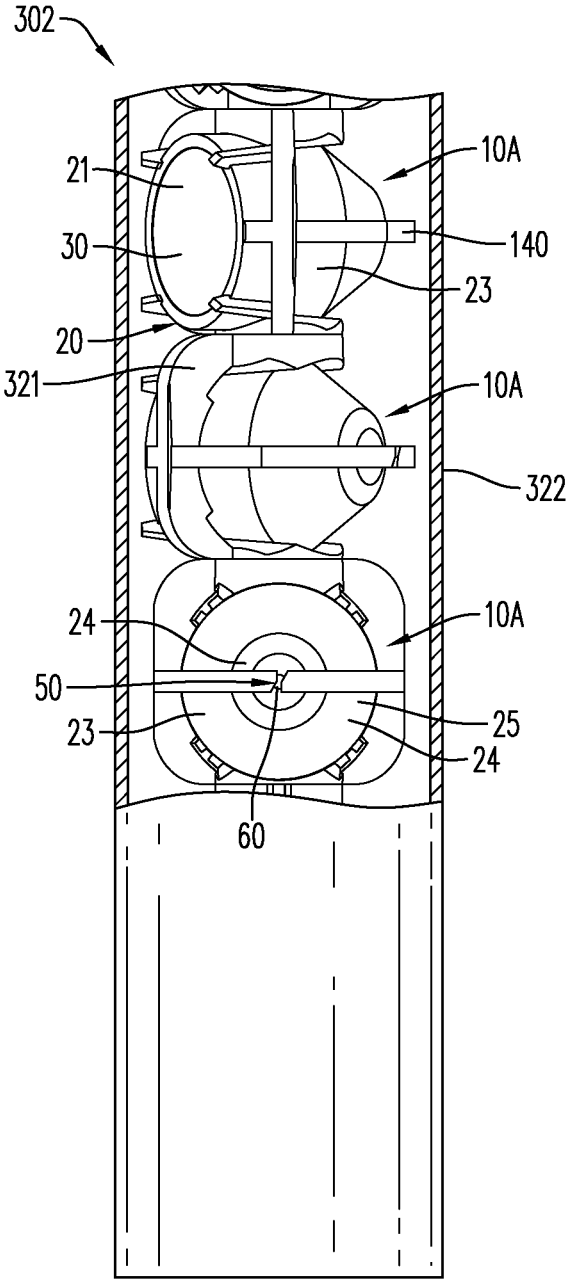
FIG. 9 is a side, partial cross-sectional view of a perforating gun including a plurality of shaped charges in an exposed gun carrier system, according to an aspect.

An alternative embodiment of an exposed perforating gun system 301, with the described shaped charges and having self-contained, compressed explosive initiation pellets 60 integrated within the shaped charges, is illustrated in FIG. 8. The hermetically sealed shaped charges 100 are illustrated as being held in place on a carrier frame 321, and are arranged in a spiral/helical configuration. The detonating cord 70 is held in place adjacent the initiating points 50 (see, for instance, FIG. 4) using the guiding members 40 of the hermetically sealed shaped charges 100. In still a further embodiment of an exposed perforating gun carrier system 302 (having the disclosed shaped charges 10A/10B/10C/10D/the hermetically sealed shaped charges 100 with integrated explosive initiation pellets 60 integrated therein) as seen in FIG. 9, spirally oriented shaped charges 10A/10B/10C/10D/encapsulated shaped charges 100 are fastened along a spiral carrier frame 321 within a surrounding carrier tube 322. Such perforating gun casing/such perforating gun systems are described in commonly-assigned U.S. Pat. No. 9,494,021, which is incorporated herein by reference in its entirety. Such systems are commercially available under the brand DYNASTAGE™ perforating systems.

Figure 10:
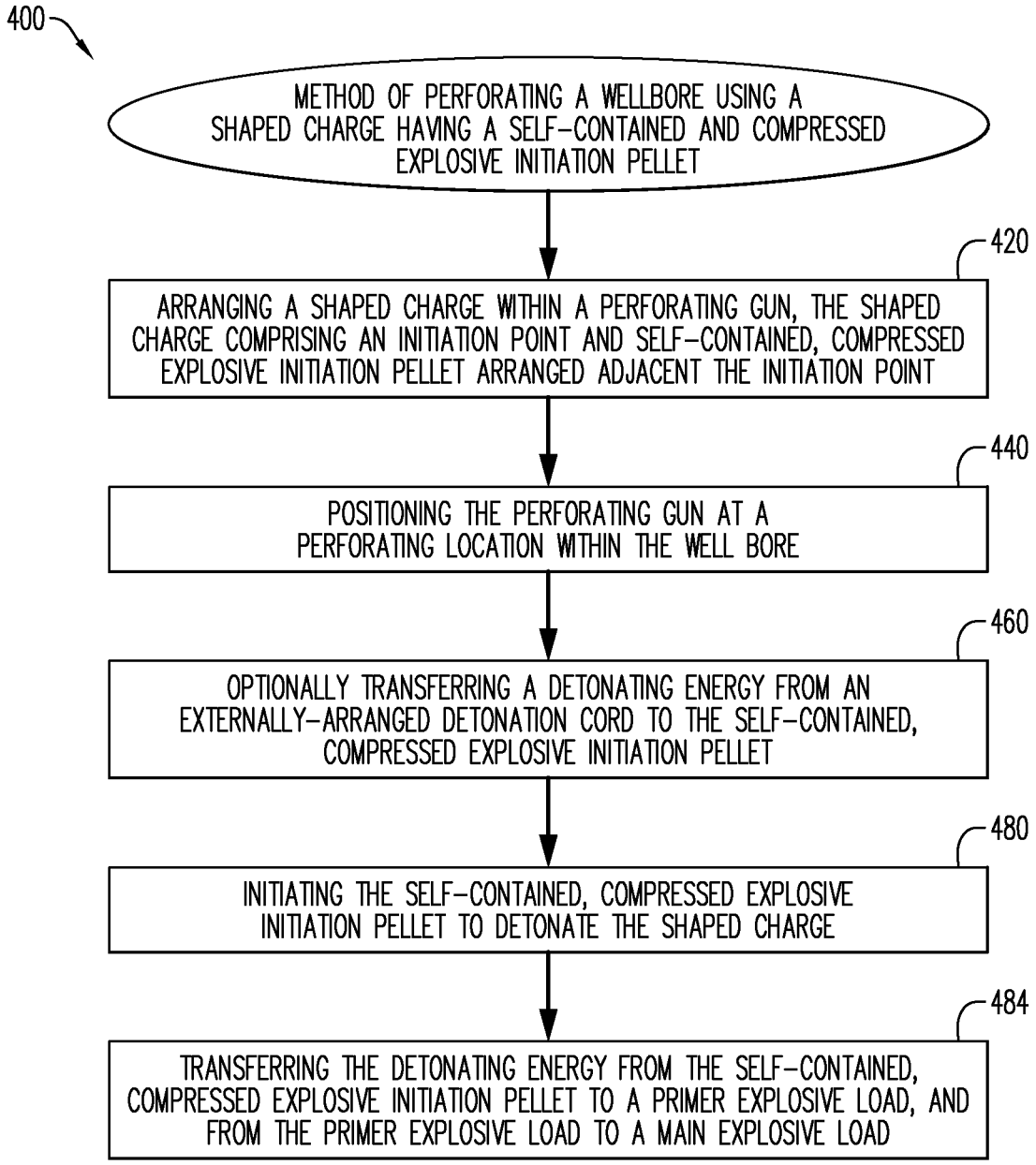
FIG. 10 is a flow chart illustrating a method of perforating a wellbore using a shaped charge having a self-contained, compressed explosive initiation pellet integrated with the shaped charge, according to an aspect.

Embodiments of the present disclosure further relate to a method 400 of perforating a wellbore using a shaped charge having a self-contained, compressed explosive initiation pellet integrated within the shaped charge. As illustrated in FIG. 10, the method includes the steps of arranging 420 at least one shaped charge (hermetically sealed or open) within a perforating gun. The shaped charge includes the explosive load disposed within the hollow interior of the case and the self-contained, compressed explosive initiation pellet within the initiation point chamber. Each of the shaped charges may be substantially as described hereinabove. The method 400 further includes the step of positioning 440 the exposed perforating gun at a perforating location within a wellbore. According to an aspect, the perforating location includes a hydraulic pressure that is less than a pressing force (i.e., compression or compaction pressure) of the self-contained, compressed explosive initiation pellet. According to an aspect, the method includes the step of initiating 480 the self-contained, compressed explosive initiation pellet to detonate the shaped charge. The initiation of the self-contained, compressed explosive initiation pellet may include the transfer of a ballistic/detonating energy from the self-contained, compressed explosive initiation pellet to the explosive load. In an embodiment, the step of initiating 480 includes transferring 460 the ballistic energy from the externally positioned detonating cord positioned adjacent the initiation point chamber, to the self-contained, compressed explosive initiation pellet positioned within the initiation point chamber of the shaped charge. The ballistic energy may thereafter be transferred from the self-contained, compressed explosive initiation pellet to the explosive load. According to an aspect, the explosive load includes a primer explosive load positioned adjacent the self-contained, compressed explosive initiation pellet, and a main explosive load positioned adjacent the primer explosive load. When the primer and main explosive loads are provided, the initiation further includes transferring 484 a detonating power (or energy produced upon initiation of the shaped charge) from the self-contained, compressed explosive initiation pellet to the primer explosive load, and from the primer explosive load to the main explosive load.

Prior to perforating, it may be desirable to keep the shaped charge (hermetically sealed or open) from being exposed to temperatures, pressures, and the like, external to the environment of the shaped charges. The shaped charges may therefore include outer and inner chamber closure walls to help maintain the self-contained, compressed explosive initiation pellets adjacent to or within the initiation point chambers, and seal the self-contained, compressed explosive initiation pellets against at least one of fluids and pressure located external to the shaped charges. The outer chamber closure wall 80 faces the areas external to the shaped charges, while the inner chamber closure wall 90 faces the hollow interiors of the shaped charges.

Figure 11:
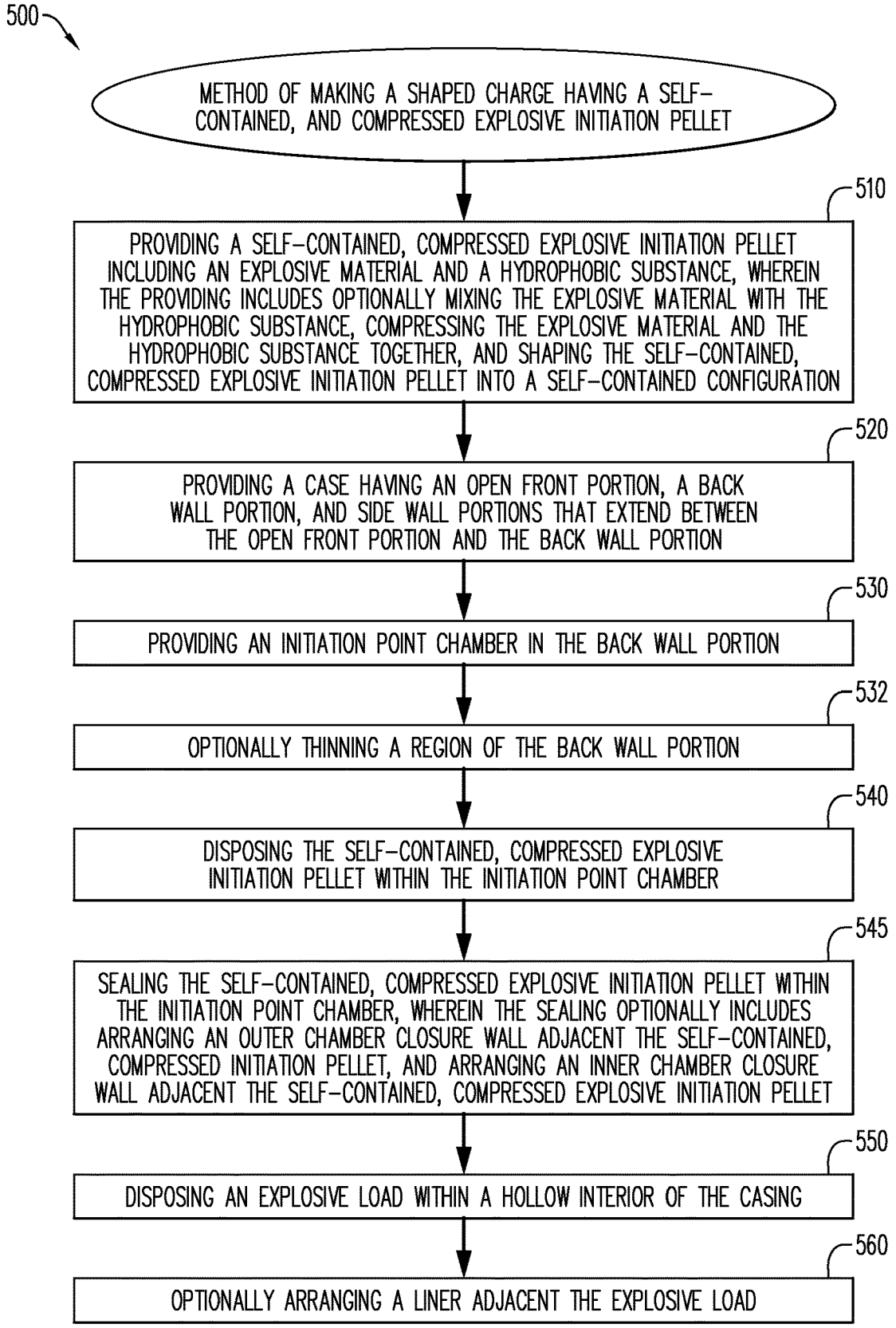
FIG. 11 is a flow chart illustrating a method of making a shaped charge having a self-contained, compressed explosive initiation pellet integrated with the shaped charge, according to an aspect.

Embodiments of the present disclosure further relate to a method 500 of making a shaped charge having a self-contained, compressed explosive initiation pellet integrated therewithin, as depicted in FIG. 11. The method 500 may include providing a self-contained, compressed explosive initiation pellet 510 comprising an explosive material. According to an aspect, the providing 510 of the self-contained, compressed explosive initiation pellet optionally includes the step of mixing 512 the explosive material with at least one hydrophobic substance, such as for example a polymer, wax or graphite material. The explosive material and the hydrophobic substance are mixed to form a mixture that retains the individual properties of the explosive material and the hydrophobic substance. Once the explosive material and the optional hydrophobic substance are mixed together, the mixture may be compressed 513 to form the self-contained, compressed explosive initiation pellet. According to an aspect, the self-contained, compressed explosive initiation pellet is hydrophobic. According to an aspect, the method 500 further includes shaping 514 the self-contained, compressed explosive initiation pellet into one of a cylindrical, spherical, and disc, or trapezoidal configuration. The method 500 also includes the step of providing a case 520 having the aforementioned open front portion, back wall portion, side wall portions extending between the open front portion and back wall portion, and hollow interior defined by the back wall portion and the side wall portions. According to an aspect, the method 500 further includes the step of providing an initiation point chamber 530 in the back wall portion, so that the initiation point chamber extends at least partially between an external surface and an internal surface of the back wall portion. The method may include disposing 540 the self-contained, compressed explosive initiation pellet within or adjacent to the initiation point chamber, and disposing 550 an explosive load within the hollow interior of the shaped charge. In an embodiment, the method further includes arranging 560 a liner adjacent the explosive load, so that the liner is housed within the hollow interior of the case. The liner is operative for retaining the explosive material of the explosive load within the hollow interior.

The method 500 of making the shaped charge having the self-contained, compressed explosive initiation pellet may further include the step of sealing 545 the self-contained, compressed explosive initiation pellet within the initiation point chamber by arranging 546 an outer chamber closure wall adjacent the self-contained, compressed explosive initiation pellet to face an area external to the shaped charge, and arranging 547 an inner chamber closure wall adjacent the self-contained, compressed explosive initiation pellet and to face the hollow interior of the shaped charge. As described in further detail hereinabove, the outer and inner chamber closure walls operatively maintain the self-contained, compressed explosive initiation pellet within or adjacent the initiation point chamber, as well as seal the self-contained, compressed explosive initiation pellet against at least one of fluids and pressure located external to the shaped charge. In an alternative embodiment of the method of making, the open front portion is covered with a cap to seal the shaped charge.

In still a further alternative embodiment of the method of making the shaped charge having the self-contained, compressed explosive initiation pellet, the initiating point chamber within the case is formed by including a through-channel through the back wall portion. In yet a further alternative embodiment of the method 500 of making, the initiating point chamber is formed by thinning 532 a region of the back wall portion. Such a thinned region may be formed by boring a hole in the case of the shaped charge to form the initiation point chamber, but not piercing through the interior wall. In yet a further alternative embodiment of the method of making, multiple explosive loads are positioned within the hollow interior of the case. In another alternative embodiment of the method of making, the self-contained, compressed explosive initiation pellet is disposed within the initiation point chamber in such a manner that it is physically separated from any other explosive load that may be disposed within the hollow interior of the case. In another alternative embodiment of the method of making, the self-contained, compressed explosive initiation pellet is formed from an explosive material that is of a different chemistry than that of any explosive load that may be loaded within the shaped charge.

The components of the apparatus illustrated are not limited to the specific embodiments described herein, but rather, features illustrated or described as part of one embodiment can be used on or in conjunction with other embodiments to yield yet a further embodiment. It is intended that the apparatus include such modifications and variations. Further, steps described in the method may be performed independently and separately from other steps described herein. Such method steps may be performed in sequences that differ from those illustrated in FIGS. 10 and 11, such as in parallel.

Such apparatus, devices, and methods may be used to enable wellbore perforation under conditions previously unavailable and/or technologically difficult. Such apparatus utilize explosive materials of differing sensitivity to detonate explosions from within shaped charges, including both open and hermetically sealed shaped charges. The shaped charges described herein, including the explosive, initiation pellet, may be used with a shaped charge carrier/perforating gun carrier system and/or an exposed perforating gun (collectively perforating gun systems) (see, for instance, FIGS. 7-9). Such perforating gun systems may be placed in a wellbore to perforate the surrounding formation, and facilitate the flow of the oil and/or gas from the wellbore.

While the apparatus and methods have been described with reference to specific embodiments, it will be understood by those skilled in the art that various changes may be made and equivalents may be substituted for elements thereof without departing from the scope contemplated. In addition, many modifications may be made to adapt a particular situation or material to the teachings found herein without departing from the essential scope thereof.

In this specification and the claims that follow, reference will be made to a number of terms that have the following meanings. The singular forms "a," "an" and "the" include plural referents unless the context clearly dictates otherwise. Furthermore, references to "one embodiment", "some embodiments", "an embodiment" and the like are not intended to be interpreted as excluding the existence of additional embodiments that also incorporate the recited features. Approximating language, as used herein throughout the specification and claims, may be applied to modify any quantitative representation that could permissibly vary without resulting in a change in the basic function to which it is related. Accordingly, a value modified by a term such as "about" is not to be limited to the precise value specified. In some instances, the approximating language may correspond to the precision of an instrument for measuring the value. Terms such as "first," "second," "upper," "lower," "inner," "outer," etc. are used to identify one element from another, and unless otherwise specified are not meant to refer to a particular order or number of elements.

As used herein, the terms "may" and "may be" indicate a possibility of an occurrence within a set of circumstances; a possession of a specified property, characteristic or function; and/or qualify another verb by expressing one or more of an ability, capability, or possibility associated with the qualified verb. Accordingly, usage of "may" and "may be" indicates that a modified term is apparently appropriate, capable, or suitable for an indicated capacity, function, or usage, while taking into account that in some circumstances the modified term may sometimes not be appropriate, capable, or suitable. For example, in some circumstances an event or capacity can be expected, while in other circumstances the event or capacity cannot occur—this distinction is captured by the terms "may" and "may be."

As used in the claims, the word "comprises" and its grammatical variants logically also subtend and include phrases of varying and differing extent such as for example, but not limited thereto, "consisting essentially of" and "consisting of." Where necessary, ranges have been supplied, and those ranges are inclusive of all sub-ranges therebetween. It is to be expected that variations in these ranges will suggest themselves to a practitioner having ordinary skill in the art and, where not already dedicated to the public, the appended claims should cover those variations.

Advances in science and technology may make equivalents and substitutions possible that are not now contemplated by reason of the imprecision of language; these variations should be covered by the appended claims. This written description uses examples to disclose the apparatus, devices, and methods, and also to enable any person of ordinary skill in the art to practice these, including making and using any apparatus, devices, or systems and performing any incorporated methods. The patentable scope thereof is defined by the claims, and may include other examples that occur to those of ordinary skill in the art. Such other examples are intended to be within the scope of the claims if they have structural elements that do not differ from the literal language of the claims, or if they include equivalent structural elements with insubstantial differences from the literal language of the claims.

What is claimed is:

1. A shaped charge comprising:

a case comprising a wall, the wall defining a hollow interior within the case and comprising an external surface and an internal surface;

an explosive load disposed within the hollow interior and positioned adjacent at least a portion of the internal surface;

an initiation point chamber extending at least partially between the external surface and the internal surface of the wall; and at least one self-contained, compressed explosive initiation pellet contained within the initiation point chamber, the at least one self-contained, compressed explosive initiation pellet comprising a mixture of an explosive material and at least one hydrophobic substance.

2. The shaped charge of claim 1, wherein the self-contained, compressed explosive initiation pellet is physically separated from the explosive load of the shaped charge.

3. The shaped charge of claim 1, wherein the initiation point chamber extends between the external surface and the internal surface of a back wall portion.

4. The shaped charge of claim 3, wherein the initiation point chamber comprises a cavity having an inner diameter, and the self-contained, compressed explosive initiation pellet comprises an outer diameter, the self-contained, compressed explosive initiation pellet being shaped and sized to be received within the inner diameter of the cavity.

5. The shaped charge of claim 4, further comprising:

an outer chamber closure wall facing an area external to the shaped charge; and an inner chamber closure wall facing the hollow interior of the shaped charge, wherein the outer and inner chamber closure walls are operative for maintaining the self-contained, compressed explosive initiation pellet within the cavity, and the outer and inner chamber closure walls are operative for sealing the self-contained, compressed explosive initiation pellet against at least one of fluids and pressure located external to the shaped charge.

6. The shaped charge of claim 5, wherein the outer chamber closure wall comprises at least one of a lacquer, a high melting temperature polymer film, a pressure sensitive adhesive appliqué, a foil sticker, and a bushing cap, and the inner chamber closure wall comprises a pressure resistant material.

7. The shaped charge of claim 1, wherein the hydrophobic substance comprises at least one of a hydrophobic polymer and graphite.

8. The shaped charge of claim 7, wherein the mixture includes an explosive material selected from the group including Hexanitrostilbene (HNS), 2,6-Bis(Picrylamino)-3,5-dinitropyridine (PYX)), and 2,4,6-triamino-1,3,5-trinitrobenzene (TATB), and a secondary material selected from the group including a hydrophobic polymer and graphite, wherein the secondary material is present in the mixture in an amount of between about 0.1% and about 5.0% of a total weight of the mixture, and the mixture is compressed during formation at a pressure of between about 10,000 psi and about 30,000 psi.

9. The shaped charge of claim 1, wherein the self-contained, compressed explosive initiation pellet comprises a high energy explosive having a thermal decomposition temperature greater than about 276° C., the high energy explosive comprising one of Hexanitrostilbene (HNS), 2,6-Bis(Picrylamino)-3,5-dinitropyridine (PYX), and 2,4,6-triamino-1,3,5-trinitrobenzene (TATB).

10. The shaped charge of claim 1, further comprising a cap to hermetically seal the shaped charge.

11. A hermetically sealed shaped charge comprising:

a case comprising an open front portion, a back wall portion, at least one side wall portion extending between the open front portion and the back wall portion, and a hollow interior defined by the back wall portion and the side wall portion;

an explosive load disposed within the hollow interior adjacent the back wall portion and the side wall portion;

an initiation point chamber disposed at the back wall portion;

at least one self-contained, compressed explosive initiation pellet within the initiation point chamber, wherein the at least one self-contained, compressed explosive initiation pellet comprising a mixture of an explosive material and at least one hydrophobic substance, wherein the mixture is compressed at a pressure of about 10,000 psi to about 30,000 psi; and a cap configured to close the open front portion of the case.

12. The hermetically sealed shaped charge of claim 11, wherein the self-contained, compressed explosive initiation pellet is physically separated from the explosive load of the shaped charge.

13. The hermetically sealed shaped charge of claim 11, wherein the case comprises a shoulder for receiving the cap thereon, the shoulder comprising a recess inwardly extending from the external surface of the case, and the cap comprises a cap retention clip for being received within the recess.

14. The hermetically sealed shaped charge of claim 11, wherein the hydrophobic substance comprises at least one of a hydrophobic polymer and graphite.

15. The hermetically sealed shaped charge of claim 11, further comprising a plurality of detonating cord guiding members outwardly extending from the external surface of the case, the guiding members being operative for aligning a detonating cord along the external surface of the shaped charge and adjacent the initiation point chamber.

16. The hermetically sealed shaped charge of claim 11, further comprising a cord retention clip, the cord retention clip being configured to restrict movement of a detonating cord externally positioned adjacent the initiation point chamber.

17. An exposed perforating gun carrier system comprising:

a shaped charge carrier tube configured for receiving a shaped charge;

the shaped charge comprises:

a case defining a hollow interior, an internal surface and an external surface, a liner housed within the case an explosive load disposed within the hollow interior and situated between the case and the liner, an initiation point chamber extending along an external surface of the case and at least one self-contained, compressed explosive initiation pellet within the initiation point chamber, wherein the at least one self-contained, compressed explosive initiation pellet comprising a mixture of an explosive material and at least one hydrophobic substance, wherein the mixture is compressed at a pressure of about 10,000 to about 30,000 psi.

18. The exposed perforating gun carrier system of claim 17, wherein the self-contained, compressed explosive initiation pellet is physically separated from the explosive load of the shaped charge.

19. The exposed perforating gun carrier system of claim 17 wherein the self-contained, compressed explosive initiation pellet is configured to transfer a ballistic energy from an externally positioned detonating cord positioned within the shaped charge carrier tube, and also adjacent the initiation point chamber.

20. The exposed perforating gun carrier system of claim 17, further comprising:

an outer chamber closure wall facing an area external to the shaped charge; and an inner chamber closure wall facing the hollow interior of the shaped charge, wherein the outer and inner chamber closure walls being operative for maintaining the self-contained, compressed explosive initiation pellet within the initiation point chamber, and sealing the self-contained, compressed explosive initiation pellet against at least one of fluids and pressure located external to the shaped charge.

* * * * *